US011668045B2

(12) United States Patent
Abbey et al.

(10) Patent No.: US 11,668,045 B2
(45) Date of Patent: Jun. 6, 2023

(54) DRYING TEXTILES

(71) Applicant: Cares Laboratory Limited, Barnsley (GB)

(72) Inventors: Thomas James Abbey, Newton Kyme (GB); David John Toms, Bromley (GB); Alex Georgia Butcher, Barnsley (GB)

(73) Assignee: CARES LABORATORY LIMITED, Barnsley (GB)

( * ) Notice: Subject to any disclaimer, the term of this patent is extended or adjusted under 35 U.S.C. 154(b) by 543 days.

(21) Appl. No.: 16/612,710

(22) PCT Filed: May 14, 2018

(86) PCT No.: PCT/GB2018/051300
§ 371 (c)(1),
(2) Date: Nov. 11, 2019

(87) PCT Pub. No.: WO2018/211250
PCT Pub. Date: Nov. 22, 2018

(65) Prior Publication Data

US 2020/0208334 A1 Jul. 2, 2020

(30) Foreign Application Priority Data

May 19, 2017 (GB) ..... 1708042

(51) Int. Cl.
*D06F 58/00* (2020.01)
*D06F 58/20* (2006.01)
(Continued)

(52) U.S. Cl.
CPC ..... *D06F 58/203* (2013.01); *C11D 17/046* (2013.01); *C11D 17/047* (2013.01); *F26B 3/00* (2013.01); *F26B 19/00* (2013.01)

(58) Field of Classification Search
CPC ..... D06F 58/203; D06F 58/30; F26B 19/00
(Continued)

(56) References Cited

U.S. PATENT DOCUMENTS 4,014,105 A * 3/1977 Furgal ..... D06F 58/30 427/242
4,567,675 A * 2/1986 Rennie ..... C11D 17/047 206/0.5
(Continued)

FOREIGN PATENT DOCUMENTS

EP 0328863 A1 8/1989
GB 1383748 A 2/1975
(Continued)

OTHER PUBLICATIONS

International Searching Authority, International Search Report and Written Opinion for International Application No. PCT/GB2018/051300, dated Jul. 2, 2018, (13 pages), Rijswijk, The Netherlands.
(Continued)

*Primary Examiner* — John P McCormack
(74) *Attorney, Agent, or Firm* — Alston & Bird LLP

(57) ABSTRACT

The present invention provides a device (100,200) to improve the drying performance of a tumble dryer, comprising a substantially curved and three-dimensional body portion (102,202) and a heat reflective layer (104,204) disposed on an outwardly facing surface of the body portion. A method of manufacturing a device to improve the drying performance of a textile drying apparatus is also provided.

17 Claims, 4 Drawing Sheets

(51) Int. Cl.

| | |
|---|---|
| ***C11D 17/04*** | (2006.01) |
| ***F26B 3/00*** | (2006.01) |
| ***F26B 19/00*** | (2006.01) |

(58) Field of Classification Search
USPC ..... 34/60
See application file for complete search history.

(56) References Cited

U.S. PATENT DOCUMENTS

| | | | | |
|---|---|---|---|---|
| 5,018,966 | A * | 5/1991 | Braun | F26B 13/10 432/2 |
| 10,179,968 | B2 * | 1/2019 | LeBrun | D06F 60/00 |
| 2005/0130868 | A1 | 6/2005 | Evans et al. | |
| 2006/0288600 | A1 | 12/2006 | Taylor | |
| 2009/0001012 | A1 | 1/2009 | Kepner et al. | |
| 2009/0307924 | A1 | 12/2009 | Aouad et al. | |
| 2014/0115919 | A1 * | 5/2014 | LeBrun | D06F 60/00 34/523 |

FOREIGN PATENT DOCUMENTS

| | | | | |
|---|---|---|---|---|
| JP | H0646285 | U * | 6/1994 | D06F 58/00 |
| WO | WO-1999/041442 | A1 | 8/1999 | |
| WO | WO-2001/032823 | A1 | 5/2001 | |
| WO | WO-2001/032825 | A1 | 5/2001 | |

OTHER PUBLICATIONS

Intellectual Property Office, Great Britain Search Report for Great Britain Patent Application No. 1708042.5, dated Jul. 12, 2017, (4 pages), South Wales, United Kingdom.

* cited by examiner

| RMC | Mean | % improvement | Material(s) | maximum cross sectional dimension (mm) | Weight (g) | maximum cross sectional dimension/ weight |
|---|---|---|---|---|---|---|
| **Control** | **24.3** | | Control | | | |
| Sphere 1 | **33.1** | **-36** | PVC | 65 | 46.0 | **-** |
| Sphere 2 | **23.9** | **2** | natural rubber covered in aluminium foil | 75 | 74.0 | **1.01** |
| Sphere 3 | **24.3** | **0** | natural rubber covered in aluminium foil | 65 | 60.0 | **1.08** |
| Sphere 4 | **18.7** | **23** | polypropylene covered in aluminium foil | 58 | 5.0 | **11.60** |
| Sphere 5 | **15.3** | **37** | Acrylic powder coated with aluminium | 60 | 6.5 | **9.23** |
| Sphere 6 | **25.4** | **-5** | Acrylic powder coated matt black pigment | 60 | 6.5 | **-** |
| Sphere 7 | **10.1** | **58** | Acrylic powder coated with aluminium | 75 | 16.0 | **4.69** |
| Sphere 8 | **3.5** | **86** | Acrylic powder coated with aluminium | 100 | 35.8 | **2.79** |
| Sphere 9 | **17.0** | **30** | Celluloid sphere covered in aluminium foil | 40 | 3.0 | **13.33** |
| Sphere 10 | **23.7** | **2** | Hollow sphere made from aluminium | 58 | 11.9 | **-** |
| Sphere 11 | **19.0** | **22** | polypropylene covered in aluminium foil | 60 | 29.0 | **2.07** |
| Sphere 12 | **19.6** | **19** | Polyurethane foam covered in aluminium foil | 70 | 40.4 | **1.73** |
| Sphere 13 | **21.3** | **12** | PVC covered in aluminium foil | 60 | 47.0 | **1.28** |
| Sphere 14 | **17.9** | **26** | polypropylene covered in aluminium foil | 60 | 40.0 | **1.50** |
| Sphere 15 | **19.4** | **20** | polypropylene covered in aluminium foil | 60 | 43.0 | **1.40** |
| Sphere 16 | **21.1** | **13** | polypropylene covered in aluminium foil | 60 | 52.0 | **1.15** |
| Egg shape 1 | **18.7** | **23** | polypropylene covered in aluminium foil | 63 | 9.4 | **6.70** |
| Cube shape 1 | **30.0** | **-23** | Polyurethane foam covered in aluminium foil | 60 | 5.7 | **-** |
| Egg shape 2 | **21.2** | **13** | polypropylene covered in aluminium foil | 63 | 12.0 | **5.25** |
| Egg shape 3 | **21.3** | **12** | polypropylene covered in aluminium foil | 63 | 10.0 | **6.30** |

Fig.3

| Test specimen | maximum cross sectional dimension/ weight | % improvement |
|---|---|---|
| 16 | 1.15 | 13 |
| 13 | 1.28 | 12 |
| 15 | 1.4 | 20 |
| 14 | 1.5 | 26 |
| 12 | 1.73 | 19 |
| 11 | 2.07 | 22 |
| 8 | 2.79 | 86 |
| 7 | 4.69 | 58 |
| Egg2 | 5.25 | 13 |
| Egg3 | 6.3 | 12 |
| Egg1 | 6.7 | 23 |
| 5 | 9.23 | 37 |
| 4 | 11.6 | 23 |
| 9 | 13.33 | 30 |

DRYING TEXTILES

CROSS REFERENCE TO RELATED APPLICATIONS

This application is a National Stage Application, filed under 35 U.S.C. § 371, of International Application No. PCT/GB2018/051300, filed May 14, 2018, which international application claims priority to Great Britain Application No. 1708042.5, filed May 19, 2017; the contents of both of which as are hereby incorporated by reference in their entireties.

BACKGROUND

Related Field

The present invention relates to dryers for removing moisture from textiles. In particular, but not exclusively, the present invention relates to a device for use in a tumble dryer to reduce the time and energy required to dry at least one textile article located in the tumble dryer.

Description of Related Art

A clothes dryer, often known as a 'tumble dryer', is a powered appliance for domestic or industrial use to remove moisture from items of clothing and/or other textile articles typically shortly after being subjected to a wash cycle in a washing machine. Conventional dryers typically include a rotating drum called a 'tumbler' through which heated air is circulated to evaporate the moisture held in the textile article. The drum is rotated to maintain a space between the articles being dried and increase the efficiency of the drying process. The hot, humid air is usually vented to atmosphere to allow additional dry, heated air to enter the drum and continue the drying process until the textile article is substantially moisture free and dry, or alternatively the water is extracted by an internal condenser and the extracted water collected in a reservoir to be subsequently emptied by the user.

However, conventional clothes dryers are particularly inefficient and require significant amounts of time and energy to fully dry a textile article. Over-drying is also a common occurrence which wastes further time and energy. The environmental impact of clothes dryers is particularly severe in the US and Canada where over 80% of all homes have a clothes dryer. Furthermore, it is known for some articles of clothing to bind together during a drying cycle which adversely affects the drying of those articles.

BRIEF SUMMARY

It is an aim of certain embodiments of the present invention to provide a device and method that substantially increases the efficiency of a tumble dryer in terms of time and energy, without imparting chemicals or deposits onto a textile article being dried and/or into the atmosphere during the drying process.

It is an aim of the certain embodiments of the present invention to provide a device and method that significantly reduces the amount of time and energy required for a domestic or industrial tumble dryer to dry a textile article.

It is an aim of certain embodiments of the present invention to provide a single use or re-usable device which allows a tumble dryer to efficiently and effectively dry a textile article, such as an item of clothing.

It is an aim of certain embodiments of the present invention to provide a device that decreases the amount of time and energy required for a tumble dryer to dry at least one textile article, whilst ensuring the textile article/s remains moving with respect to the drum and aerated during the drying process, and are not damaged by introduction of the device/s.

According to a first aspect of the present invention there is provided a device to improve the drying performance of a tumble dryer, comprising:

- a substantially curved and three-dimensional body portion; and
- a heat reflective layer disposed on an outwardly facing surface of the body portion.

Optionally, a maximum cross sectional dimension of the device is around 30-100 mm.

Optionally, a weight of the device is around 3-55 g.

Optionally, a ratio of the maximum cross sectional dimension to the weight is at least 1.15.

Optionally, the ratio is between around 2 and 5.

Optionally, the body portion is substantially spherical, cylindrical, conical, toroidal, or egg-shaped, or at least defines a portion of such a three-dimensional shape.

Optionally, the body portion is substantially spherical.

Optionally, the body portion is substantially hollow defining at least one wall portion and an interior region.

Optionally, the wall portion has a thickness of between around 0.4 mm and around 1 mm.

Optionally, the wall portion comprises at least one opening extending into the interior region.

Optionally, the wall portion comprises a plurality of spaced apart openings each extending into the interior region.

Optionally, the body portion comprises a substantially non-heat conducting material.

Optionally, the at least one heat reflective layer comprises a metallic material.

Optionally, the at least one heat reflective layer comprises aluminium.

Optionally, the body portion comprises a plastics material.

According to a second aspect of the present invention there is provided a use of a device according to the first aspect of the present invention to improve the drying performance of a textile drying apparatus.

According to a third aspect of the present invention there is provided a method of manufacturing a device to improve the drying performance of a textile drying apparatus, comprising:

- providing a substantially curved and three-dimensional body portion; and
- disposing a heat reflective layer on an outwardly facing surface of the body portion.

Optionally, the method further comprises applying an adhesive to the outwardly facing surface of the body portion prior to disposing the heat reflective layer thereon.

Optionally, disposing comprises applying a powder coat on the outwardly facing surface of the body portion.

Optionally, the heat reflective layer comprises aluminium.

Optionally, the body portion comprises a plastics material.

Optionally, the body portion is substantially spherical.

BRIEF DESCRIPTION OF THE FIGURES

Certain embodiments of the present invention will now be described with reference to the accompanying drawings in which:

FIG. 3 illustrates a set of test results associated with different heat reflective devices according to certain embodiments of the present invention;

DETAILED DESCRIPTION OF VARIOUS EMBODIMENTS

Figure 1:
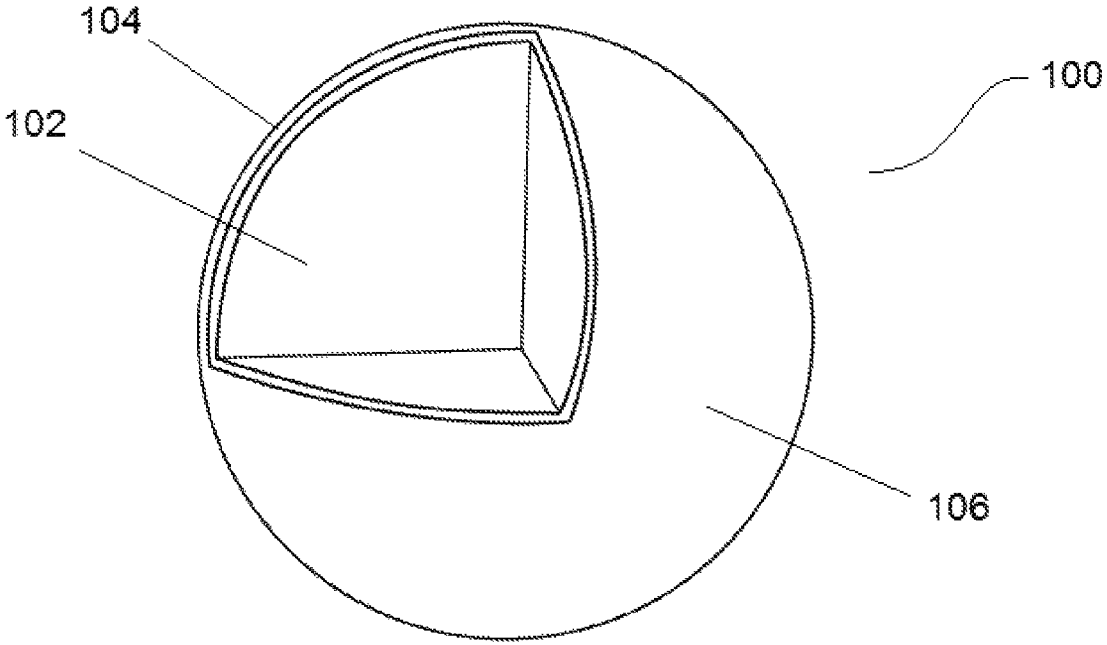
FIG. 1 illustrates a substantially solid device according to certain embodiments of the present invention.

As illustrated in the FIG. 1, a device 100 according to certain embodiments of the present invention includes a substantially solid body or core portion 102 and a heat reflective surface layer 104 located thereon to provide the device with a heat reflective outwardly facing and substantially curved surface 106. It will be understood that the term 'layer' for the heat reflective layer includes a coating, film, or the like.

The device 100 as illustrated is substantially spherical but may be substantially pyramidal, conical, egg-shaped, or cuboidal, or the like, and have a substantially curved heat reflective outer surface. The heat reflective surface is aptly provided by a separate coating/layer/film applied to the outer surface/s of the body portion. For example, a polymer body portion may be powder coated with aluminium, or the like, to provide a substantially curved and heat reflective device.

The diameter of the spherical device as illustrated in FIG. 1 is around 60 mm but may be around 40 mm to around 100 mm in diameter depending on the material and desired weight of the body portion 102. A 60 mm diameter spherical device 100 having a substantially solid polyurethane foam or polystyrene body portion/core 102 weighs around 5 to 15 g depending on the thickness/material of the heat reflective layer supported thereon. A celluloid sphere having a diameter of around 40 mm weighs around 3 g. Aptly, the weight of the device is less than around 55 g, and suitably around 15-40 g, so that the device does not get caught up in the textile items being dried which prevents the same efficiently reflecting heat in all directions around, and particularly into the centre of, the drum and throughout the textile items being dried.

Figure 2:
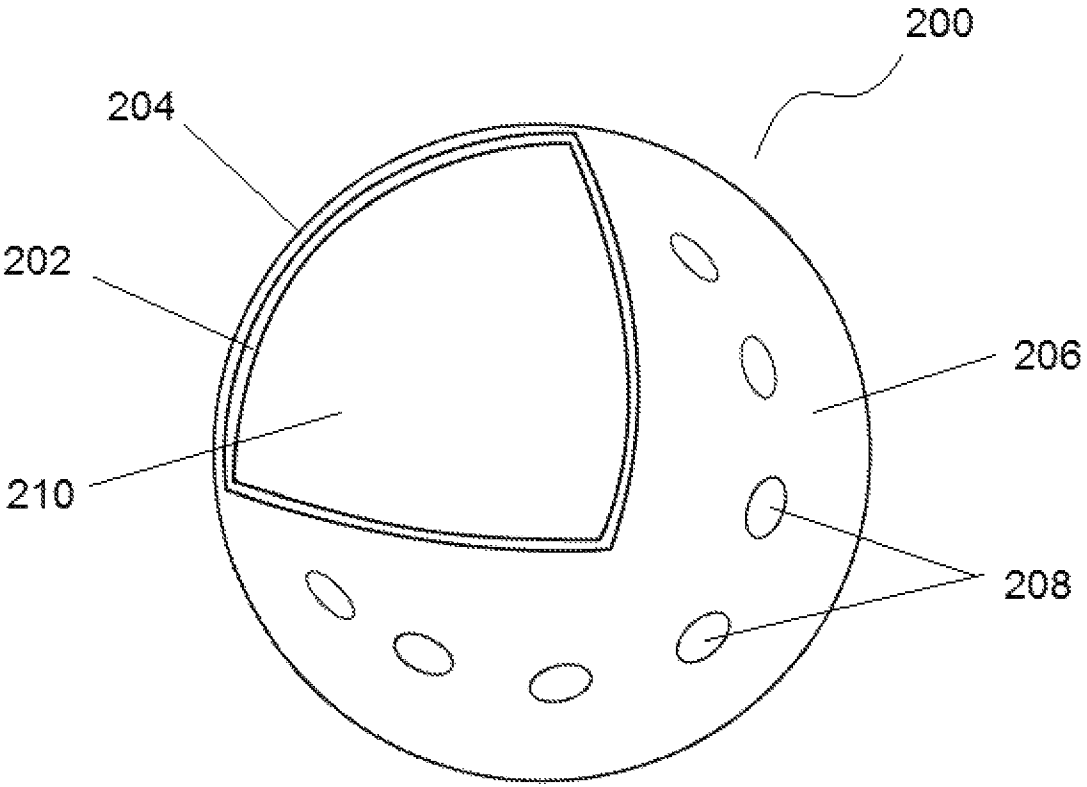
FIG. 2 illustrates a substantially hollow device according to certain embodiments of the present invention.

FIG. 2 illustrates a device 200 according to certain alternative embodiments of the present invention. The device 200 includes a substantially hollow body portion 202 and a heat reflective layer 204 located thereon to provide the device with a heat reflective outwardly facing and substantially curved surface 206. Optionally, at least one aperture 208 is disposed in the hollow body portion to provide access into an interior region 210 of the device 100. An active ingredient, e.g. a perfume, powder/liquid softener, or the like, may be located in the interior region 210 via the aperture 208 before the device is placed into a tumble dryer, and the ingredients can be gradually released from the device via the at least one aperture during a drying cycle. Aptly, as illustrated, the device 200 optionally includes a plurality of spaced apart apertures 208 extending into the interior region 210. However, the device may be substantially hollow without any apertures in the wall thereof.

The thickness of the wall of the hollow body portion 202 is aptly between around 0.4 mm and around 1.0 mm and the heat reflective layer/coating 202 is a few micrometres thick. The diameter of the device 200 is around 40 mm to around 100 mm in diameter depending on the material and desired weight of the body portion. Aptly, the device weighs less than around 55 g and suitably around 15-40 g. A hollow acrylic sphere powder coated with aluminium and having a maximum diameter of around 100 mm weighs around 36 g and a hollow acrylic sphere powder coated with aluminium and having a diameter of around 60 mm weighs around 6.5 g.

The substantially hollow body portion 202 may be a metal material, such as stainless steel, aluminium, silver, gold, or the like, or aptly a plastics material, such as acetal (polyoxymethylene), acrylic, cellulose acetate, polystyrene, polyester, high density polyethylene (HDPE), low density polyethylene, nitrile, Nylon™, polypropylene, PTFE, PVC, or the like. Aptly, the body portion is substantially resistant to collapse/crumpling during a tumble-drying cycle, inexpensive, non-complex to manufacture, e.g. by moulding, strong, lightweight, and substantially heat resistant.

The heat reflective layer 104,204 is aptly a relatively thin layer, aptly between around 0.01 mm and 0.5 mm thick, of a metallic material, such as a metal, metal alloy or metal oxide, or a coloured and polished plastics material. The heat reflective layer may be silver, gold, or aluminium, or the like. Aptly, alloys/mixtures of aluminium may be used. The outer surface of the heat reflective layer is aptly silver, gold, amber-gold, copper, bronze, or the like, in colour. A lacquer may be used to protect the outer surface of the heat reflective layer and to provide the colour thereof. Aptly, the heat reflective layer/coating may be applied to the body portion by polishing, painting, powder coating, wet or dry coating, or wrapping or the like.

A substantially spherical, or the like, and hollow body made of a relatively stiff material, such as a plastic or metal, desirably holds its shape and is substantially resistant to collapse/crumpling during a tumble-drying cycle when in use. The outer surface of the body portion is substantially smooth and curved to reduce the risk of snagging with, and damage to, the drum and textile article/s being dried. The weight of a substantially hollow body portion is minimised and, as such, the level of noise during the drying cycle is also reduced. A substantially smooth and curved body ensures the device does not become caught up with the textile article/s being dried to rotate therewith, but instead helps to agitate the textile article/s being dried to ensure the article/s remains moving with respect to a drum of a tumble dryer and remains aerated during the drying cycle, without moving/becoming snagged with the articles themselves.

A number of tests were performed by the applicant using a conventional washing machine, a conventional tumble dryer, 2 kg white cotton cut into 4×500 g pieces, drying aid sample under test, and a balance for weighing the test specimens. Each test was repeated at least ten times, aptly around twenty times, and the mean result was recorded. The total weight of the interlocked cotton sheets was first recorded before the sheets were placed into the washing machine. A 30-minute cold wash cycle was carried out including a 1200 speed spin cycle with no additions to the machine. The damp sheets were immediately removed from the washing machine and the 'after-washing' total weight was recorded. The damp sheets were then placed in the tumble dryer and subjected to a drying cycle of 60 minutes. The sheets were then immediately removed from the tumble dryer and the 'after-drying' total weight was recorded. The remaining moisture content (RMC) was calculated as a percentage using the following equation:

$$\frac{\text{final weight of damp fabric} - \text{weight of dry fabric}}{\text{original weight of damp fabric} - \text{weight of dry fabric}} \times 100$$

The damp sheets were then returned to the tumble dryer until completely dry for re-use in a subsequent test.

As shown in the table of FIG. 3, a hollow PVC sphere (sphere 1) having no heat reflective outer surface, a diameter of 65 mm and weighing 46 g had a significantly detrimental effect to the drying performance (−36%) of the tumble dryer. Similarly, an acrylic sphere (sphere 6) having a matt black outer coating and a diameter of 60 mm and weighing 6.5 g showed a reduced drying performance of −5%. As such, in comparison with the further results that follow, it can be seen that a spherical device having a heat reflective outer surface increases the dryer performance of a tumble dryer.

Figures 4, 5:
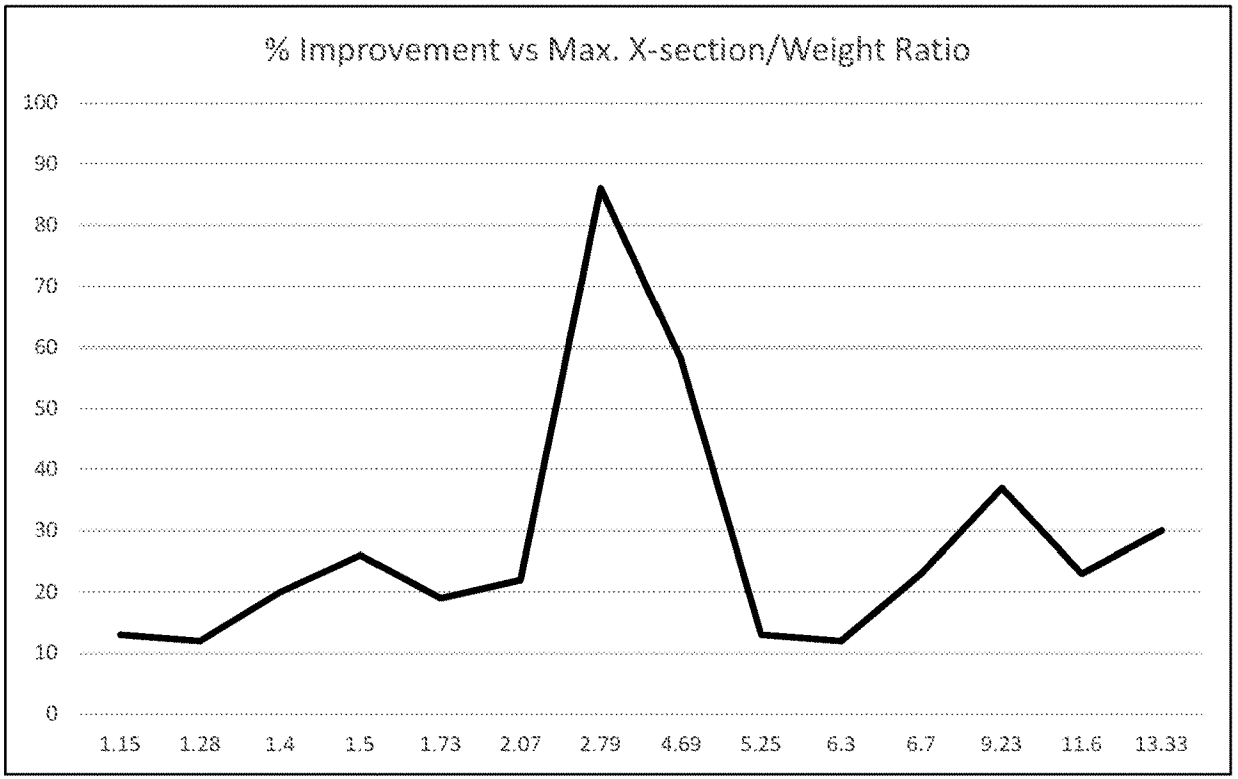
FIG. 4 illustrates the maximum cross-sectional diameter/weight data of the table in FIG. 3 against increasing % improvement in drying performance.
FIG. 5 illustrates a graph of the data in FIG. 4.

Spheres 2 and 3 which each consisted of a hollow rubber core covered in an aluminium foil, whilst having slightly different diameters and weights, showed a negligible if no increase in drying performance when compared to the control. The maximum cross sectional diameter/weight ratios for these two test specimens were 1.01 and 1.08 respectively. The results for spheres 12 to 16 which had slightly higher maximum cross sectional dimension/weight ratios of between 1.15 and 1.73 showed an increase in drying performance when compared to the control of between 12 and 26%. Sphere 12 comprised a solid polyurethane foam body portion having an aluminium foil covering. As shown best by the table of FIG. 4, the optimum ratio is between around 2.1 and 5.1 for increased drying performance. As shown by the results of spheres 4, 5 and 9, the drying performance decreases from optimum with increased maximum dimension/weight ratio, although the performance of these test specimens is still desirable. As such, the size and weight of the device are particularly important factors, in combination with a heat reflective outer surface, for improved drying performance of a tumble dryer.

The hollow aluminium sphere (sphere 9) having a diameter of 58 mm and weighing 11.9 g (ratio of 4.87) showed only a 2% increase in drying performance. This result shows that a device having a poor-heat conducting body, such as a plastics material, and a heat reflective outer surface is desirable.

A number of additional tests were performed to assess the performance of devices having a non-spherical cross section. It was found that a polyurethane foam cube covered in aluminium foil and having no curved surfaces had a particularly detrimental effect on the drying performance of the tumble dryer, whilst substantially egg-shaped test specimens of different weights (by adding weights inside to assess the effects on max. dimension/weight ratios) all showed an increase in drying performance.

It has therefore been shown that a device according to certain embodiments of the present invention comprising a substantially curved and three-dimensional body portion and a heat reflective outer surface has a particularly desirable effect on the drying performance of a tumble dryer. Aptly, the body portion is a hollow and substantially spherical body portion of a non-, or at least poor, heat conducting material, such as acrylic or polypropylene or the like, and having an aluminium coating applied thereto. Aptly, the body portion has a maximum diameter of around 40-100 mm and weighs around 3-40 g. Aptly, the maximum cross sectional dimension, e.g. maximum diameter, to weight ratio of the device is at least 1.15 and aptly between around 2.1 and 5.1.

Certain embodiments of the present invention therefore provide a device, use and method that substantially increases the efficiency and performance of a clothes drying process by a tumble dryer in terms of time and energy, without imparting chemicals or residues onto the textile article being dried and/or into the atmosphere or drainage system during the drying process. The amount of time and energy required for a domestic or industrial tumble dryer to dry a textile material is desirably reduced. Shorter drying times are desirable if items of clothing are required quickly and/or if a family for example has lots of laundry to dry and/or in view of the existing concerns about tumble dryers catching fire and thus not being operated at night or when a house is unattended. Shorter drying times also mean less fibre damage which prolongs the life of the textile article and the tumble dryer itself. In view of increased drying performance, the tumble dryer can be operated on a lower drying temperature saving energy and cost and further prolonging the life of the textile article and the dryer heater. The presence of a non-metallic device according to certain embodiments of the present invention also helps to reduce/prevent static build-up amongst articles being dried. The device may be re-usable which saves on material, waste, cost and energy, and one or more device may be used in a single drying cycle depending on the desired drying performance and/or the amount/characteristics of the textile article/s to be dried. The substantially curved and smooth outer surface of the device ensures the risk of damage to a textile item is minimised/prevented and also ensures the device continually moves with respect to the item/s and does not become snagged or caught up therewith. The device also helps to separate and aerate and soften the textile items during a tumble-drying cycle, and does not substantially increase noise or vibration levels of the tumble dryer.

The invention claimed is:

1. A device to improve the drying performance of a tumble dryer, the device comprising:

a three-dimensional plastic body portion consisting of a single outwardly facing curved surface therearound and substantially resistant to collapse during a tumble-drying cycle; and a metallic heat reflective layer disposed on and substantially covering the single outwardly facing curved surface of the body portion, wherein a maximum cross-sectional dimension of the device is 30-100 millimeters, and a weight of the device is 3-55 grams.

2. The device as claimed in claim 1, wherein a ratio of a maximum cross-sectional dimension to the weight of the device is at least 1.15.

3. The device as claimed in claim 2, wherein the ratio is between 2 and 5.

4. The device as claimed in claim 1, wherein the plastic body portion is substantially spherical, cylindrical, conical, toroidal, or egg-shaped, or at least defines a portion of such a three-dimensional shape.

5. The device as claimed in claim 4, wherein the plastic body portion is substantially spherical.

6. The device as claimed in claim 1, wherein the plastic body portion is substantially hollow defining at least one wall portion and an interior region.

7. The device as claimed in claim 6, wherein the wall portion has a thickness of between 0.4 mm and 1 mm.

8. The device as claimed in claim 6, wherein the wall portion comprises at least one opening extending into the interior region.

9. The device as claimed in claim 8, wherein the wall portion comprises a plurality of spaced apart openings each extending into the interior region.

10. The device as claimed in claim 1, wherein the metallic heat reflective layer is aluminum.

11. The device as claimed in claim 1, wherein the metallic heat reflective layer is a substantially smooth layer disposed on and substantially covering the single outwardly facing curved surface of the body portion.

12. A method of manufacturing a device to improve the drying performance of a tumble dryer, the method comprising the steps of:

providing three-dimensional plastic body portion consisting of a single outwardly facing curved surface therearound and substantially resistant to collapse during a tumble-drying cycle; and disposing a metallic heat reflective layer on and substantially covering the single outwardly facing curved surface of the body portion, wherein a maximum cross-sectional dimension of the device is 30-100 millimeters, and a weight of the device is 3-55 grams.

13. The method as claimed in claim 12, further comprising the step of applying an adhesive to the outwardly facing curved surface of the plastic body portion prior to disposing the metallic heat reflective layer thereon.

14. The method as claimed in claim 12, wherein the disposing step comprises applying a powder coat on the outwardly facing curved surface of the plastic body portion.

15. The method as claimed in claim 12, wherein the metallic heat reflective layer comprises aluminum.

16. The method as claimed in claim 12, wherein the body portion is substantially spherical.

17. The method as claimed in claim 12, wherein the metallic heat reflective layer is a substantially smooth layer disposed on and substantially covering the single outwardly facing curved surface of the body portion.

* * * * *